US007401486B2

(12) United States Patent
Okui et al.

(10) Patent No.: US 7,401,486 B2
(45) Date of Patent: Jul. 22, 2008

(54) DIE, METHOD OF MANUFACTURING STEPPED METAL PIPE OR TUBE, AND STEPPED METAL PIPE OR TUBE

(75) Inventors: Tatsuya Okui, Osaka (JP); Koichi Kuroda, Osaka (JP); Masayoshi Akiyama, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 44 days.

(21) Appl. No.: 10/581,993

(22) PCT Filed: Aug. 30, 2005

(86) PCT No.: PCT/JP2005/015739

§ 371 (c)(1),
(2), (4) Date: Jun. 7, 2006

(87) PCT Pub. No.: WO2006/025369

PCT Pub. Date: Mar. 9, 2006

(65) Prior Publication Data

US 2007/0157694 A1 Jul. 12, 2007

(30) Foreign Application Priority Data

Aug. 31, 2004 (JP) ..... 2004-253085

(51) Int. Cl.
*B21C 25/08* (2006.01)

(52) U.S. Cl. ..... 72/260; 72/467; 72/253.1

(58) Field of Classification Search ..... 72/260, 72/467, 370.1, 370.24, 253.1, 271; 76/107.1, 76/107.4
See application file for complete search history.

(56) References Cited

U.S. PATENT DOCUMENTS 6,449,997 B1 * 9/2002 Bertolini ..... 72/41

FOREIGN PATENT DOCUMENTS

| | | |
|---|---|---|
| JP | 52-035629 | 9/1977 |
| JP | 10-099922 | 4/1998 |
| JP | 2002-011518 | 1/2002 |

* cited by examiner

*Primary Examiner*—Derris H. Banks
*Assistant Examiner*—Debra M Wolfe
(74) *Attorney, Agent, or Firm*—Clark & Brody

(57) ABSTRACT

A die through hole has an inside surface including a bell portion, an approach portion, and a bearing portion from the entrance side. The diameter of the approach portion is D1 on its entrance side and D2 on its exit side and gradually decreases from the entrance side to the exit side. The diameter satisfies Equation (1): $0.7 \leqq D2/D1 < 0.97$. The die half angle of an inside surface where the diameter D3 is D2/0.97 is not less than the die half angle R2 of an inside surface nearer to the approach portion exit side than the inside surface where the diameter is D3. The axial distance LR from the inside surface where the diameter is D3 to the inside surface where the diameter is D2 satisfies Equation (2): $20 \leqq LR/((D3-D2)/2) \leqq 115$. The through hole diameter at the bearing portion is fixed at D2, and the length is LB and satisfies Equation (3): $0.3 \leqq LB/D2 \leqq 10$.

3 Claims, 9 Drawing Sheets

DIE, METHOD OF MANUFACTURING STEPPED METAL PIPE OR TUBE, AND STEPPED METAL PIPE OR TUBE

BACKGROUND OF THE INVENTION

1. Field of the Invention

The present invention relates to a die, a method of manufacturing a stepped metal pipe or tube, and a stepped metal pipe or tube. The invention more specifically relates to a die for use in an extrusion process for reducing the diameter of a metal pipe or tube, a method of manufacturing a stepped metal pipe or tube using the die, and a stepped metal pipe or tube.

2. Description of the Related Art

Among automobile parts such as a shaft, some parts have a stepped shape of varying diameter in the axial direction (hereinafter referred to as "stepped parts") as shown in FIG. 1. Such a stepped part is manufactured by subjecting a solid material to an extrusion process and reducing its diameter. Referring to FIGS. 2A to 2D, a columnar solid material is cut into billets 1 having a prescribed length (FIG. 2A). Then, a billet 1 is placed in the vertical direction on a die 2 for extrusion, and a press 3 is placed on the upper end of the billet 1 (FIG. 2B). The billet 1 is then pushed into a through hole 21 of the die 2 and the lower end of the billet 1 is forced out from the lower surface of the die 2 (FIG. 2C). The lower end of the billet 1 is extruded to protrude a prescribed distance from the lower surface of the die 2, and then the billet 1 is pushed out from the die 2 using a push-out jig 4 (FIG. 2D). By these processes, the billet 1 is formed into a stepped part.

As shown in FIG. 2B, the through hole 21 of the die 2 has an inside surface including a bell portion 211, an approach portion 212, a bearing portion 213, and a relief portion 214 formed in a continuous manner. The bell portion 211 serves to guide the billet 1 toward the approach portion 212. Compressing force in the radial direction is exerted for the first time on the billet 1 by the approach portion 212, and the diameter of the billet is reduced. The die half angle R1 of the approach portion 212 is usually fixed.

In recent years, in order to manufacture more lightweight automobiles, stepped metal pipes or tubes produced by extruding hollow metal pipes or tubes are coming to be used as stepped parts.

However, when a stepped metal pipe or tube is produced by a conventional extrusion process using the die 2, the cylindrical portion with a reduced diameter is bent as shown in FIG. 3. A stepped metal pipe or tube attached to an automobile usually rotates in the axial direction. A bent stepped metal pipe or tube is not preferable because it vibrations during rotation.

Japanese Patent Laid-Open No. 2002-11518 discloses a die for use in a drawing process. Unlike the extrusion process carried out without fixing the tip end of the material, the tip end of the material is chucked while it is pulled out in the drawing process, and therefore it is not easy for bending to occur. Therefore, the die for drawing and the die for extrusion have different shapes.

SUMMARY OF THE INVENTION

It is an object of the invention to provide a die that can prevent the bending deformation of a stepped metal pipe or tube manufactured by extruding a metal pipe or tube and a stepped metal pipe or tube manufactured using such a die from occurring.

The inventors subjected a metal pipe or tube (hereinafter as "metal pipe") 10 to an extrusion process by pushing it into a conventional die 2 as shown in FIG. 4 in order to find the cause of bending of a stepped metal pipe. The inventors found that the reduced outside diameter DB of the metal pipe 10 becomes smaller than the diameter D11 of the through hole 21 in the bearing portion 213 of the die 2. Such deformation will hereinafter be referred to as "undershooting deformation."

When the metal pipe 10 is subjected to an extrusion process using the die 2, the part of the metal pipe 10 passing through the approach portion 212 undergoes bending deformation in the radial direction by the inside surface of the approach portion 212 and has its diameter reduced.

The part let out of the approach portion 212 and existing in the bearing portion 213 undergoes no bending deformation by the inside surface of the bearing portion 213, but the part, in the process of passing through the approach portion 212, is affected by the bending deformation at the moment undergoes bending deformation by the inside surface of the approach portion 212. This causes undershooting deformation.

When lubrication is not uniform or the metal pipe 10 is slightly slanted with respect to the die 2 during the extrusion process, the metal pipe 10 has its diameter reduced unevenly with respect to the axis of the pipe 10. The reduced outside diameter DB of the metal pipe 10 becomes smaller than the diameter D11 at the bearing portion 213 because of the undershooting deformation, and therefore the metal pipe 10 is not restrained by the bearing portion 213. The non-uniform deformation portion in the metal pipe 10 caused by the working by the approach portion 212 cannot be straightened by the bearing portion 213. Consequently, the extruded metal pipe 10 has a bent portion.

The inventors drew a conclusion that the bending of the stepped metal pipe can be reduced if the undershooting deformation of the metal pipe is prevented from occurring at the bearing portion 213. This is because the metal pipe 10 is restrained by the bearing portion 213 if there is no undershooting deformation of the metal pipe at the bearing portion 213.

In order to prevent undershooting deformation of the metal pipe from occurring at the bearing portion 213, it is sufficient to allow the undershooting deformation to start and to be completed before the outside diameter of the metal pipe 10 is reduced to D11 by the extrusion process.

The inventors therefore subjected metal pipes having various outside diameters DA and thicknesses to an extrusion process using a die 2 and investigated undershooting deformation of the metal pipes 10. It was newly found based on the results that when the working ratio of the outside diameter is not more than 30% in an extrusion process, the undershooting deformation of the metal pipe 10 is less than 3% of the diameter D11 of the bearing portion 213. Note that the undershooting deformation did not depend on the outside diameter DA and the thickness of the metal pipe 10 before the extrusion process.

The inventors have made the following invention based on the studies and results of examination described above.

A die according to the invention has a through hole for use in an extrusion process to reduce the diameter of a metal pipe or tube. The through hole has an inside surface including a bell portion, an approach portion, and a bearing portion from the entrance side formed in a continuous manner. The diameter of the through hole at the bell portion gradually decreases from the entrance side of the bell portion to the exit side of the bell portion, and the diameter of the through hole at the approach portion is D1 on the entrance side of the approach portion and D2 on the exit side of the approach portion and gradually decreases from the entrance side of the approach portion to the exit side to satisfy Equation (1):

$$0.7 \leqq D2/D1 \leqq 0.97 \quad (1)$$

The die half angle of the inside surface where the diameter D3 is D2/0.97 is not less than the die half angle of the inside surface nearer to the exit side of the approach portion than the inside surface where the diameter is D3, and the axial length LR from the inside surface where the diameter is D3 to the inside surface where the diameter is D2 satisfies Equation (2):

$$20 \leqq LR/((D3-D2)/2) \leqq 115 \quad (2):$$

The diameter of the through hole in the bearing portion is fixed at D2, and the length is LB and satisfies Equation (3):

$$0.3 \leqq LB/D2 \leqq 10 \quad (3)$$

In the die according to the invention, the die half angle of an inside surface where the diameter of the through hole at the approach portion is D3 is not less than the die half angle of an inside surface more on the exit side than the inside surface where the diameter is D3, and the length LR satisfies Equation (2). Therefore, the die half angle is small on the inside surface more on the exit side than the inside surface where the diameter is D3, and the metal pipe or tube between the inside surface where the diameter is D3 and the exit of the approach portion undergoes almost no bending deformation. Consequently, the metal pipe is allowed to undergo undershooting deformation when the pipe passes through the region from the inside surface where the diameter is D3 to the exit of the approach portion. As can be understood from the results of examination described above, the undershooting deformation is less than 3% when the working ratio of the outside diameter is not more than 30%, and therefore the undershooting deformation of the metal pipe or tube occurring from the inside surface where the diameter is D3 ends before the metal pipe or tube reaches the exit of the approach portion. Stated differently, no undershooting deformation occurs after the metal pipe or tube passes the approach portion. Consequently, the metal pipe or tube is restrained by the bearing portion.

The length of the bearing portion satisfies Equation (3) and therefore non-uniform deformation portion of the metal pipe or tube caused by the working by the approach portion can be straightened. In this way, the bending of the metal pipe or tube can be prevented.

A method of manufacturing a stepped metal pipe or tube according to the invention includes pushing a metal pipe or tube into a die in the axial direction, extruding an end of the pushed metal pipe or tube to protrude a prescribed length from the exit side of the die, thereby making the metal pipe or tube into a stepped metal pipe or tube, and stopping extruding and pushing back the stepped metal pipe or tube in the direction opposite to the direction of pushing the metal pipe or tube. The die has a through hole for use in an extrusion process to reduce the diameter of a metal pipe or tube. The through hole has an inside surface including a bell portion, an approach portion, and a bearing portion from the entrance side formed in a continuous manner. The diameter of the through hole at the bell portion gradually decreases from the entrance side of the bell portion to the exit side of the bell portion, the diameter of the through hole at the approach portion is D1 on the entrance side of the approach portion and D2 on the exit side of the approach portion and gradually decreases from the entrance side to the exit side to satisfy Equation (1), the die half angle of an inside surface where the diameter D3 is D2/0.97 is not less than the die half angle of an inside surface more on the exit side of the approach portion than the inside surface where the diameter is D3, the axial length LR from the inside surface where the diameter is D3 to the inside surface where the diameter is D2 satisfies Equation (2), the diameter of the through hole in the bearing portion is fixed at D2, and the length is LB and satisfies Equation (3).

The metal pipe or tube is preferably manufactured by a Mannesmann process.

A stepped metal pipe or tube according to the invention includes a first hollow cylindrical portion, a taper portion, and a second hollow cylindrical portion formed in a continuous manner, the outside diameter of the first hollow cylindrical portion is DA, the outside diameter of the second hollow cylindrical portion is DB that is smaller than DA, the outside diameter of the taper portion gradually decreases from the first hollow cylindrical portion to the second hollow cylindrical portion as the value of the outer diameter decreases from DA to DB, and the axial distance LE from the surface where the outside diameter DC is DB/0.97 to the surface where the outside diameter is DB satisfies Equation (4):

$$20 \leqq LE/((DC-DB)/2) \leqq 115 \quad (4)$$

DETAILED DESCRIPTION OF THE PREFERRED EMBODIMENTS

Figure 1:
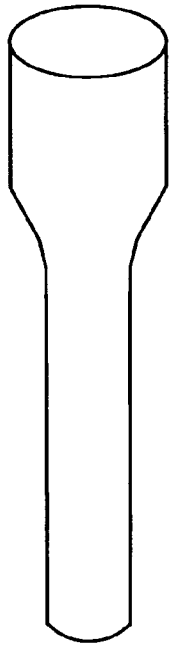
FIG. 1 PRIOR ART
FIG. 1 is an external view of a conventional stepped part.
Figure 2A:
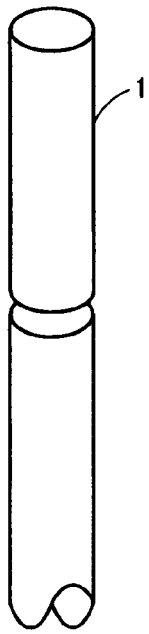
FIGS. 2A to 2D are views of the first to the forth steps in an extrusion process using a conventional die.
Figure 2B:
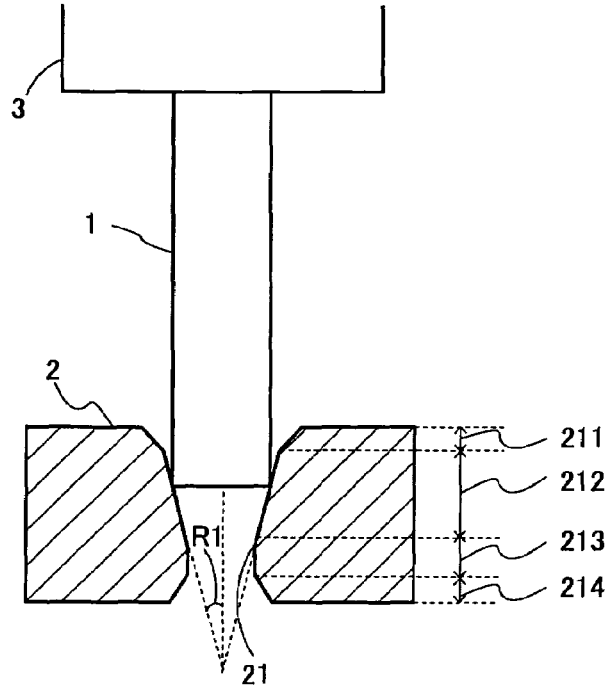
Figure 2C:
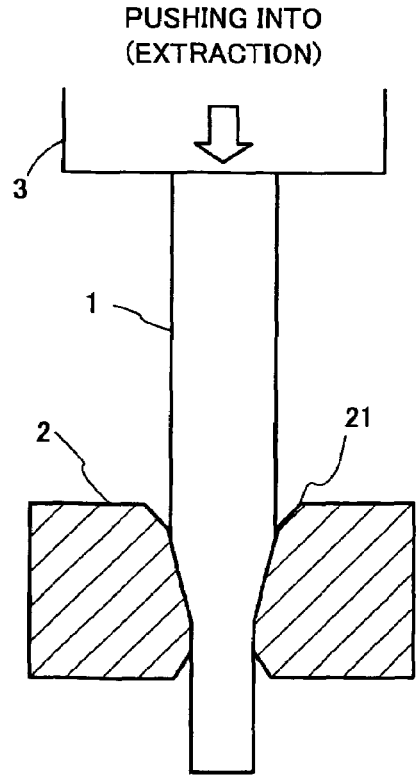
Figure 2D:
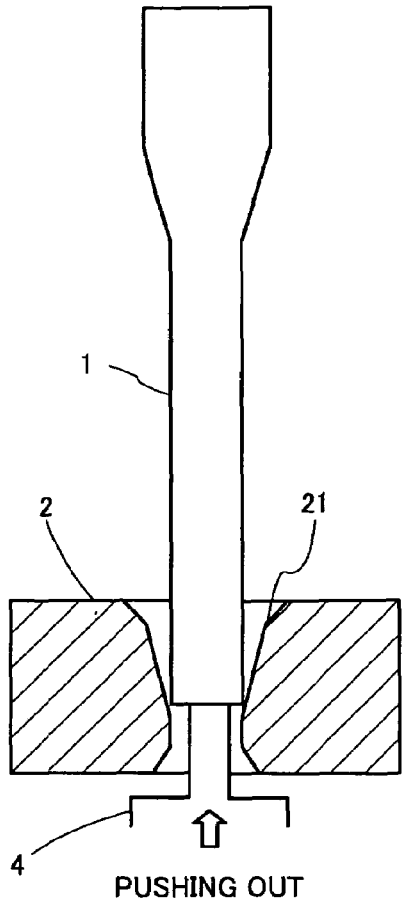
Figure 3:
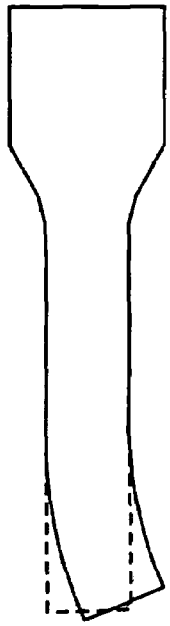
FIG. 3 is an external view of a stepped part having a bent end portion.
Figure 4:
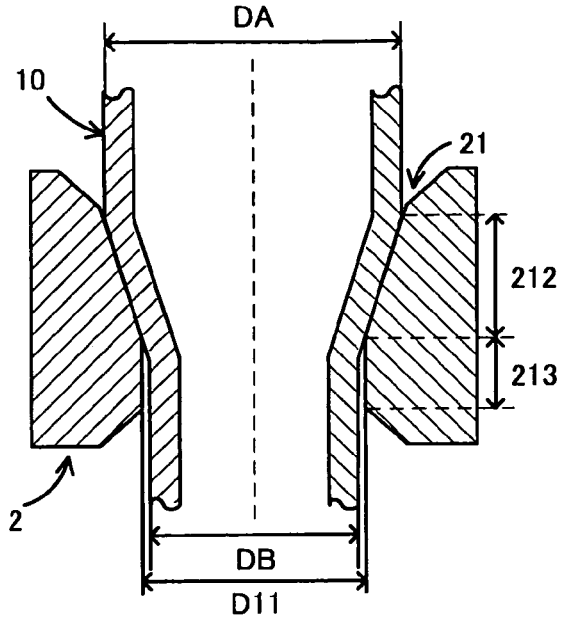
FIG. 4 is a schematic view for illustrating the cause of the bending of a stepped metal pipe during an extrusion process.

Now, an embodiment of the invention will be described in detail in conjunction with the accompanying drawings, in which the same or corresponding portions are denoted by the same reference numerals and their descriptions are also the same as or similar to each other.

1. Die

Figure 5:
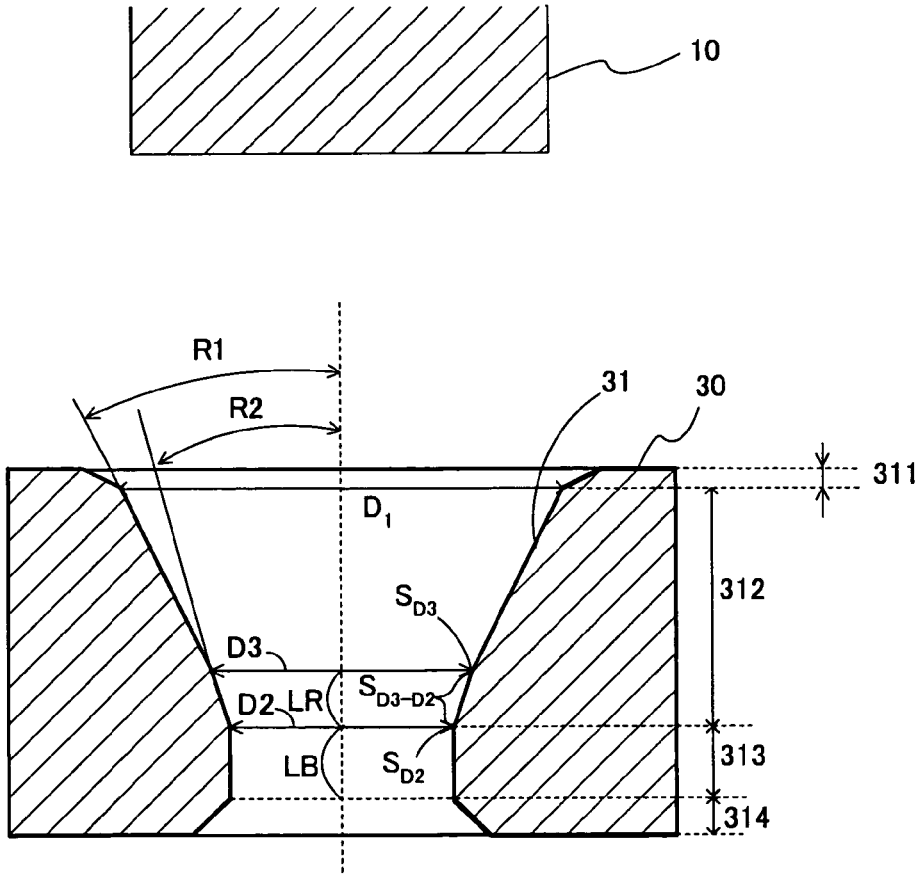
FIG. 5 is a sectional view of a die according to an embodiment of the invention taken in the vertical direction.

Referring to FIG. 5, a die 30 according to the embodiment has a through hole 31. The geometry of the through hole 31 has an inside surface that starts from a bell portion 311 on the entrance side followed by an approach portion 312, a bearing portion 313, and a relief portion 314 in a continuous manner.

Now, the geometry of the through hole 31 will be detailed.

1. 1. Bell portion

The bell portion 311 serves to guide a metal pipe 10 into the through hole 31. The bell portion 311 does not exert compressing force on the metal pipe 10, and therefore the metal pipe 10 does not have its diameter reduced by the bell portion 311. The diameter of the through hole 31 at the bell portion 311 decreases gradually from the entrance side to the exit side.

1. 2. Approach Portion

The approach portion 312 serves to reduce the diameter of the metal pipe 10. In short, the metal pipe 10 receives compressing force exerted in the radial direction for the first time on the approach portion 312 and has its diameter reduced. The diameter of the through hole 31 at the approach portion 312 gradually decreases from the entrance side to the exit side. When the diameter of the entrance of the approach portion 312 is D1, and the diameter of its exit is D2, D1 and D2 satisfy the following Equation (1):

$$0.7 \leqq D2/D1 < 0.97 \quad (1)$$

The lower limit in Equation (1) is 0.7 because the advantage of the invention is particularly effectively obtained when the working ratio of the outside diameter of the metal pipe 10 is not more than 30%. Herein, the working ratio of the outside diameter is defined by the following Equation (A):

$$\text{Working Ratio of Outside Diameter} = (DA - DB)/DA \times 100(\%) \quad (A)$$

where DA represents the outside diameter of the metal pipe 10 before extrusion, and DB represents the outside diameter of the metal pipe 10 having a reduced diameter after the extrusion. Note that even for a value smaller than the lower limit in Equation (1), the advantage of the invention can be obtained to some extent. The upper limit is 0.97 in Equation (1) because the advantage of the invention cannot be obtained effectively when the working ratio of the outside diameter is less than 3%.

At the approach portion 312, the die half angle R1 of the inside surface $S_{D3}$ where the diameter D3=D2/0.97 is not less than the die half angle R2 of the inside surface $S_{D3-D2}$ more on the exit side than the inside surface $S_{D3}$.

The axial length LR from the inside surface $S_{D3}$ to the inside surface $S_{D2}$ where the diameter is D2 satisfies the following Equation (2):

$$20 \leqq LR/((D3 - D2)/2) \leqq 115 \quad (2)$$

As the length LR becomes longer with respect to the diameter difference D3−D2, the die half angle R2 on the inside surface $S_{D3-D2}$ becomes smaller.

In order to prevent the metal pipe 10 from undergoing undershooting deformation at the bearing portion 313, it is sufficient that undershooting deformation is intentionally caused while the pipe passes through the approach portion 312, and the undershooting deformation is finished before the pipe reaches the exit of the approach portion 312. When the die half angle R1 of the inside surface $S_{D3}$ where D3 is D2/0.97 is not less than the die half angle R2 of the inside surface $S_{D3-D2}$, and the length LR satisfies Equation (2), the die half angle R2 is very small. Therefore, as shown in FIG. 6, the metal pipe 10 does not contact the die 30 on the entrance side of the inside surface $S_{D3-D2}$ (see the region 50 in FIG. 6), and undergoes undershooting deformation at the inside surface $S_{D3-D2}$.

As described above, when the working ratio of the outside diameter of the metal pipe 10 is not more than 30%, the undershooting deformation is less than 3% of the diameter D2. Therefore, when undershooting deformation is caused from the inside surface $S_{D3}$, the outside diameter of the metal pipe 10 after the undershooting deformation is more than D2.

Figure 6:
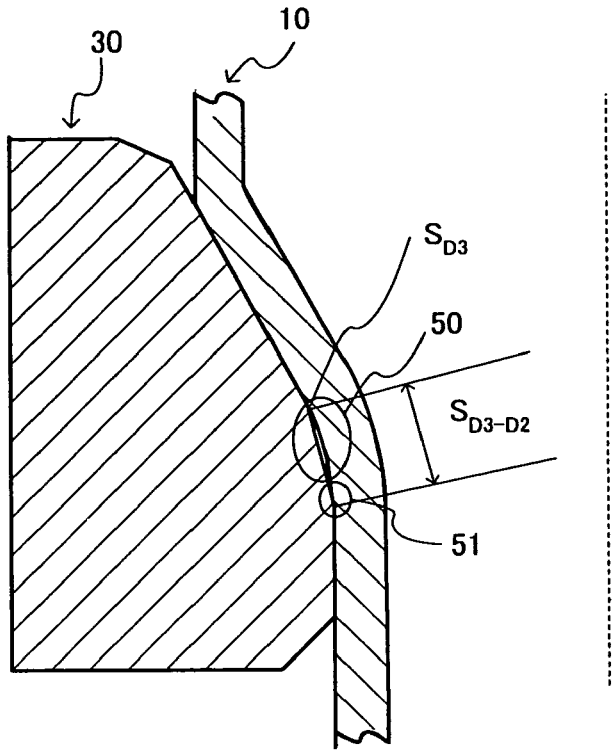
FIG. 6 is a schematic view for illustrating the state of a metal pipe when it is processed by extrusion using the die as shown in FIG. 5.

The metal pipe 10 after the undershooting deformation again contacts the approach portion 312 and has its diameter slightly reduced before it reaches the entrance of the bearing portion 313 (see the region 51 in FIG. 6). However, since the working ratio of the outside diameter is low and the die half angle R2 of the inside surface $S_{D3-D2}$ is small, compressing force exerted on the metal pipe 10 in the region is very small. Therefore, no undershooting deformation is caused by the bearing portion 313.

Note that when the length LR is not less than the lower limit in Equation (2), the above described advantage can effectively be provided. The upper limit in Equation (2) is 115 because with the length LR longer than this value the entire length of the die 30 becomes too long. This pushes up the manufacturing cost for the die and the installation cost for the press. When the upper limit in Equation (2) is more than 115, the advantage of the invention can effectively be provided.

Figure 7:
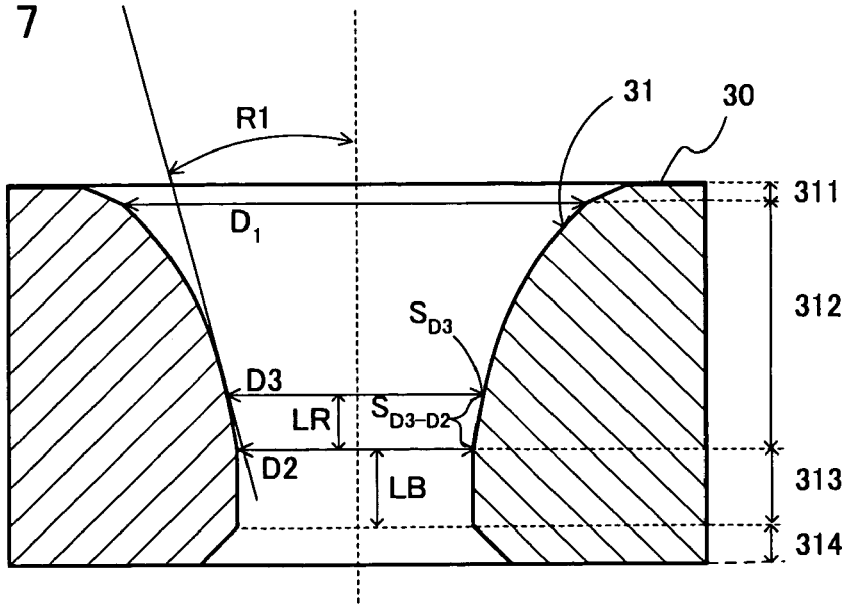
FIG. 7 is a sectional view of another example of the die according to the embodiment of the invention.

In FIG. 5, the approach portion 312 has a two section straight geometry along the inside surface from the entrance to the inside surface $S_{D3}$, then to the inside surface $S_{D3-D2}$, but it may have a different geometry. For example, as shown in FIG. 7, the approach portion 312 may be curved. In short, it is sufficient that the die has its diameter gradually reduced from the entrance side to the exit side of the approach portion 312, the die half angle R1 is not less than the die half angle R2, and the length LR satisfies Equation (2). Note that when the approach portion 312 is curved as shown in FIG. 7, the die half angle refers to the angle formed between a tangent line to a prescribed inside surface on the approach portion 312 and the central axis of the through hole 31.

1.3. Bearing Portion

The bearing portion 313 serves to restrain the extruded metal pipe 10 and improve the straightness of the metal pipe 10. The length LB of the bearing portion 313 satisfies the following Equation (3):

$$0.3 \leqq LB/D2 \leqq 10 \quad (3)$$

The bearing portion length LB is in proportion to the diameter D2. As the bearing portion length LB is longer, non-uniform deformation portion of the metal pipe 10 caused by the working by the approach portion 312 can be more straightened. In this way, the metal pipe 10 can be prevented from bending. When the bearing portion length LB satisfies Equation (3), the above-described advantage can effectively be obtained and the straightness of the metal pipe 10 is improved. Note that the upper limit in Equation (3) is 10 because with the bearing portion length LB larger than the value the die 30 becomes too long. This pushes up the manufacturing cost for the die. If the upper limit is higher than the value in Equation (3), the above-described advantage can effectively be obtained.

2. Manufacturing Method

A method of manufacturing a stepped metal pipe according to the embodiment will be described. Molten steel is produced either by a blast furnace or by an electric furnace. The produced molten steel is then refined by a conventional process. The refined molten steel is processed by a continuous casting method or by an ingot casting method and formed into, for example, a slab, a bloom, a billet or an ingot.

The slab, bloom or ingot is processed by hot working and made into a billet. The hot working process can be either a hot rolling process or a hot forging process.

In the following process, the billet is processed into a metal pipe by a Mannesmann process. In the process, the billet is pierced by a piercing mill and made into a hollow shell (piercing process). The hollow shell is elongated in the axial direction by a mandrel mill (elongating process). After the elongating process, the outside diameter of the hollow shell is sized to a specified value by a sizing mill (sizing process).

Figure 8A:
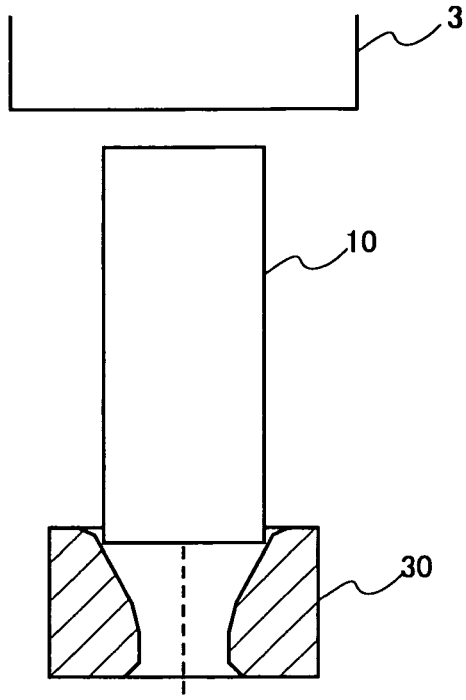
FIGS. 8A to 8C are views of the first to the third steps in an extrusion process using the die shown in FIG. 5.
Figure 8B:
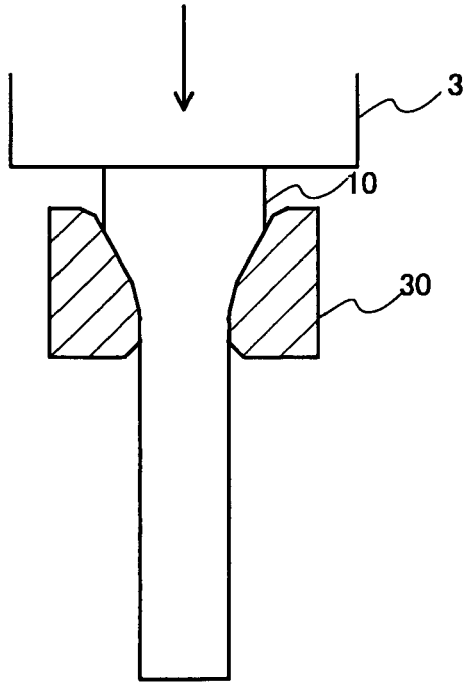
Figure 8C:
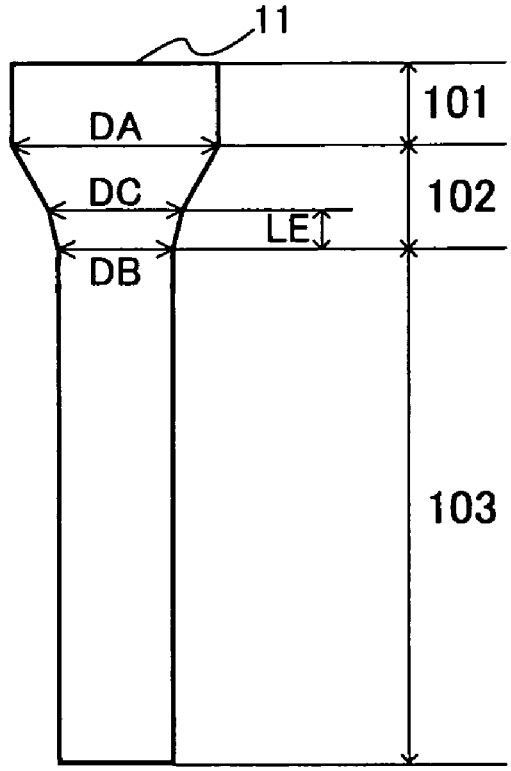
Figure 8C:
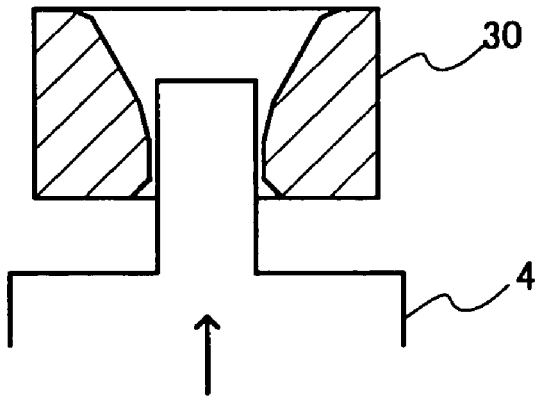

The metal pipe manufactured by the Mannesmann process is subjected to an extrusion process to manufacture a stepped metal pipe. With reference to FIGS. 8A to 8C, a prescribed length of the metal pipe 10 is provided between a press 3 that presses the metal pipe 10 in the vertical direction and a die 30 (FIG. 8A). Then, the upper end of the metal pipe 10 is pressed in the vertical direction by the press 3 and the lower end of the metal pipe 10 is pushed into the die 30. The lower end of the metal pipe 10 is extruded to protrude a prescribed distance from the lower end of the die 30, and then the extrusion process by the press 3 is stopped (FIG. 8B). At this time, the metal pipe 10 becomes a stepped metal pipe 11. Then, the metal pipe 11 is pushed back by a push-out jig 4 in the direction opposite to the direction in which the stepped metal pipe 11 is extruded (FIG. 8C).

The stepped metal pipe 11 manufactured by this extrusion process includes a first hollow cylindrical portion 101, a taper portion 102, and a second hollow cylindrical portion 103 formed in a continuous manner. The outside diameter of the first hollow cylindrical portion 101 is DA, and the outside diameter DB of the second hollow cylindrical portion 103 is smaller than DA.

The outside diameter of the taper portion 102 gradually decreases from the first hollow cylindrical portion 101 to the second hollow cylindrical portion 103. In other words, the diameter gradually decreases from DA to DB. Furthermore, the axial length LE from the surface where the outside diameter is DC is DB/0.97 to the surface where the outside diameter is DB satisfies the following Equation (4):

$$20 \leqq LE/((DC-DB)/2) \leqq 115 \quad (4)$$

The above-described method of manufacturing a metal pipe according to the Mannesmann process includes the processes of piercing, rolling, and sizing, while the method may include other processes. For example, the process of straightening the bent portion of the metal pipe in the axial direction or the process of improving the roundness of the metal pipe may be carried out after the sizing process and before manufacturing the stepped metal pipe. The straightening process is carried out by a device such as a straightener. In order to adjust mechanical characteristics of the metal pipe such as strength and ductility, thermal treatment may be carried out between the sizing process and the straightening process. After the straightening process, the metal pipe may be subjected to a swaging process in order to adjust the inside diameter of the end of the metal pipe (swaging process). For example, the end of the metal pipe may be pushed into a die for extrusion and have its inside diameter adjusted. In this method, the process of manufacturing the stepped pipe is carried out after the swaging process.

The stepped metal pipe manufactured by the processes in FIGS. 8A to 8C may be subjected to thermal treatment in order to eliminate possible redundant strain or residual stress on the stepped metal pipe caused by the working. The thermal treatment may also be carried out for the purpose of adjusting mechanical characteristics of the stepped metal pipe such as the strength and ductility.

By the above-described manufacturing method, a seamless pipe is used as a metal pipe, but a stepped metal pipe may be manufactured using a welded steel pipe as a metal pipe.

There is no restriction on the material of the die 30. For example, the material can be either high-speed steel or cemented carbide. There is no restriction on the roughness of the inside surface of the through hole 31. The inside surface may be a polished surface or a mirror finished surface. The inside surface of the through hole 31 may be coated.

Although the die half angle of the bell portion 311 and the die half angle R1 of the approach portion 312 are different in FIG. 5, these angles may be the same.

EXAMPLE 1

Metal pipes and dies sized as in Table 1 were used to carry out extrusion tests, and the bending of the metal pipes after the extrusion was examined.

TABLE 1

| | die | | | | | | | | | metal pipe | | | | | metal pipe | | |
|---|---|---|---|---|---|---|---|---|---|---|---|---|---|---|---|---|---|
| | | | | | | | | | | outside diameter | | outside diameter | bending | | outside diameter | | |
| No. | D1 (mm) | D2 (mm) | D3 (mm) | R1 (°) | R2 (°) | LR (mm) | LB (mm) | F1 | F2 | DA (mm) | thickness (mm) | DB (mm) | S (mm) | eval-uation | DC (mm) | LE (mm) | Exp. (4) |
| 1 | 50 | 34 | 35.05 | 10 | 6.0 | 10 | 40.0 | *19.0 | 1.18 | 40 | 6 | 33.6 | 0.7 | x | — | — | — |
| 2 | 50 | 34 | 35.05 | 10 | 4.0 | 15 | 40.0 | 28.5 | 1.18 | 40 | 6 | 34.0 | 0.3 | ○ | 35.1 | 13.8 | 26.2 |
| 3 | 50 | 34 | 35.05 | 10 | 3.0 | 20 | 40.0 | 38.0 | 1.18 | 40 | 6 | 34.0 | 0.3 | ○ | 35.1 | 18.8 | 35.8 |
| 4 | 50 | 34 | 35.05 | 10 | 2.0 | 30 | 40.0 | 57.1 | 1.18 | 40 | 6 | 34.0 | 0.3 | ○ | 35.1 | 27.1 | 51.5 |
| 5 | 50 | 34 | 35.05 | 10 | 1.2 | 50 | 40.0 | 95.1 | 1.18 | 40 | 6 | 34.0 | 0.3 | ○ | 35.1 | 47.2 | 89.8 |
| 6 | 50 | 34 | 35.05 | 10 | 0.9 | 70 | 40.0 | 133.1 | 1.18 | 40 | 6 | 34.0 | 0.3 | ○ | — | — | — |
| 7 | 50 | 34 | 35.05 | 10 | 10.0 | 3 | 40.0 | *11.4 | 1.18 | 40 | 6 | 33.5 | 0.8 | x | 34.5 | 9.9 | *19.1 |
| 8 | 50 | 34 | 35.05 | 25 | 6.0 | 10 | 40.0 | *19.0 | 1.18 | 40 | 6 | 33.5 | 0.8 | x | — | — | — |
| 9 | 50 | 34 | 35.05 | 25 | 4.0 | 15 | 40.0 | 28.5 | 1.18 | 40 | 6 | 34.0 | 0.5 | ○ | 35.1 | 13.6 | 25.9 |
| 10 | 50 | 34 | 35.05 | 25 | 3.0 | 20 | 40.0 | 38.0 | 1.18 | 40 | 6 | 34.0 | 0.4 | ○ | 35.1 | 18.2 | 34.6 |
| 11 | 50 | 34 | 35.05 | 25 | 2.0 | 30 | 40.0 | 57.1 | 1.18 | 40 | 6 | 34.0 | 0.4 | ○ | 35.1 | 26.1 | 49.6 |
| 12 | 50 | 34 | 35.05 | 25 | 1.2 | 50 | 40.0 | 95.1 | 1.18 | 40 | 6 | 34.0 | 0.4 | ○ | 35.1 | 47.0 | 89.4 |
| 13 | 50 | 34 | 35.05 | 25 | 0.9 | 70 | 40.0 | 133.1 | 1.18 | 40 | 6 | 34.0 | 0.4 | ○ | — | — | — |
| 14 | 50 | 34 | 35.05 | 25 | 25.0 | 1 | 40.0 | *45 | 1.18 | 40 | 6 | 33.6 | 0.9 | x | 34.6 | 7.5 | *14.4 |
| 15 | 50 | 34 | 35.05 | 40 | 6.0 | 10 | 40.0 | *19.0 | 1.18 | 40 | 6 | 33.6 | 0.9 | x | — | — | — |
| 16 | 50 | 34 | 35.05 | 40 | 4.0 | 15 | 40.0 | 28.5 | 1.18 | 40 | 6 | 34.0 | 0.5 | ○ | 35.1 | 13.5 | 25.7 |
| 17 | 50 | 34 | 35.05 | 40 | 3.0 | 20 | 40.0 | 38.0 | 1.18 | 40 | 6 | 34.0 | 0.45 | ○ | 35.1 | 18.0 | 34.2 |
| 18 | 50 | 34 | 35.05 | 40 | 2.0 | 30 | 40.0 | 57.1 | 1.18 | 40 | 6 | 34.0 | 0.45 | ○ | 35.1 | 27.9 | 53.1 |
| 19 | 50 | 34 | 35.05 | 40 | 1.2 | 50 | 40.0 | 95.1 | 1.18 | 40 | 6 | 34.0 | 0.45 | ○ | 35.1 | 48.0 | 91.3 |
| 20 | 50 | 34 | 35.05 | 40 | 0.9 | 70 | 40.0 | 133.1 | 1.18 | 40 | 6 | 34.0 | 0.45 | ○ | — | — | — |
| 21 | 50 | 34 | 35.05 | 40 | 40.0 | 1 | 40.0 | *2.7 | 1.18 | 40 | 6 | 33.6 | 1.1 | ○ | 34.6 | 4.5 | *8.7 |
| 22 | 50 | 34 | 35.05 | 25 | 6.0 | 10 | 40.0 | *19.0 | 1.18 | 40 | 4 | 33.6 | 0.9 | x | — | — | — |
| 23 | 50 | 34 | 35.05 | 25 | 4.0 | 15 | 40.0 | 28.5 | 1.18 | 40 | 4 | 34.0 | 0.45 | ○ | 35.1 | 13.0 | 24.7 |

TABLE 1-continued

| | die | | | | | | | | | metal pipe | | | | | metal pipe | | |
|---|---|---|---|---|---|---|---|---|---|---|---|---|---|---|---|---|---|
| | | | | | | | | | | outside diameter | | outside diameter | bending | | outside diameter | | |
| No. | D1 (mm) | D2 (mm) | D3 (mm) | R1 (°) | R2 (°) | LR (mm) | LB (mm) | F1 | F2 | DA (mm) | thickness (mm) | DB (mm) | S (mm) | eval-uation | DC (mm) | LE (mm) | Exp. (4) |
| 24 | 50 | 34 | 35.05 | 25 | 3.0 | 20 | 40.0 | 38.0 | 1.18 | 40 | 4 | 34.0 | 0.45 | ○ | 35.1 | 17.9 | 34.0 |
| 25 | 50 | 34 | 35.05 | 25 | 2.0 | 30 | 40.0 | 57.1 | 1.18 | 40 | 4 | 34.0 | 0.45 | ○ | 35.1 | 26.0 | 49.5 |
| 26 | 50 | 34 | 35.05 | 25 | 1.2 | 50 | 40.0 | 95.1 | 1.18 | 40 | 4 | 34.0 | 0.4 | ○ | 35.1 | 46.2 | 87.9 |
| 27 | 50 | 34 | 35.05 | 25 | 0.9 | 70 | 40.0 | 133.1 | 1.18 | 40 | 4 | 34.0 | 0.4 | ○ | — | — | — |
| 28 | 50 | 34 | 35.05 | 25 | 25.0 | 1 | 40.0 | *4.5 | 1.18 | 40 | 4 | 33.5 | 1 | x | 34.5 | 7.0 | *13.5 |
| 29 | 50 | 34 | 35.05 | 10 | 2.0 | 30 | 8.0 | 57.1 | *0.24 | 40 | 6 | 34.0 | 0.8 | x | — | — | — |
| 30 | 50 | 34 | 35.05 | 10 | 2.0 | 30 | 15.0 | 57.1 | 0.44 | 40 | 6 | 34.0 | 0.3 | ○ | 35.1 | 26.9 | 51.2 |
| 31 | 50 | 34 | 35.05 | 10 | 2.0 | 30 | 20.0 | 57.1 | 0.59 | 40 | 6 | 34.0 | 0.3 | ○ | 35.1 | 26.2 | 49.8 |
| 32 | 50 | 34 | 35.05 | 10 | 2.0 | 30 | 40.0 | 57.1 | 1.18 | 40 | 6 | 34.0 | 0.3 | ○ | 35.1 | 26.1 | 49.6 |
| 33 | 50 | 34 | 35.05 | 10 | 2.0 | 30 | 60.0 | 57.1 | 1.76 | 40 | 6 | 34.0 | 0.25 | ○ | 35.1 | 26.8 | 51.0 |
| 34 | 50 | 34 | 35.05 | 10 | 2.0 | 30 | 80.0 | 57.1 | 2.35 | 40 | 6 | 34.0 | 0.2 | ○ | — | — | — |
| 35 | 50 | 34 | 35.05 | 10 | 10.0 | 3 | 80.0 | *11.4 | 2.35 | 40 | 6 | 33.6 | 0.9 | ○ | 34.6 | 9.8 | *18.9 |
| 36 | 50 | 34 | 35.05 | 25 | 2.0 | 30 | 8.0 | 57.1 | *0.24 | 40 | 6 | 34.0 | 1 | x | — | — | — |
| 37 | 50 | 34 | 35.05 | 25 | 2.0 | 30 | 15.0 | 57.1 | 0.44 | 40 | 6 | 34.0 | 0.4 | ○ | 35.1 | 26.5 | 50.4 |
| 38 | 50 | 34 | 35.05 | 25 | 2.0 | 30 | 20.0 | 57.1 | 0.59 | 40 | 6 | 34.0 | 0.4 | ○ | 35.1 | 26.5 | 50.4 |
| 39 | 50 | 34 | 35.05 | 25 | 2.0 | 30 | 40.0 | 57.1 | 1.18 | 40 | 6 | 34.0 | 0.4 | ○ | 35.1 | 26.8 | 51.0 |
| 40 | 50 | 34 | 35.05 | 25 | 2.0 | 30 | 60.0 | 57.1 | 1.76 | 40 | 6 | 34.0 | 0.3 | ○ | 35.1 | 26.0 | 49.5 |
| 41 | 50 | 34 | 35.05 | 25 | 2.0 | 30 | 80.0 | 57.1 | 2.35 | 40 | 6 | 34.0 | 0.3 | ○ | — | — | — |
| 42 | 50 | 34 | 35.05 | 25 | 25.0 | 1 | 80.0 | *45 | 2.35 | 40 | 6 | 33.5 | 1.1 | x | 34.5 | 69 | *13.3 |
| 43 | 50 | 34 | 35.05 | 40 | 2.0 | 30 | 8.0 | 57.1 | *0.24 | 40 | 6 | 34.0 | 1 | x | — | — | — |
| 44 | 50 | 34 | 35.05 | 40 | 2.0 | 30 | 15.0 | 57.1 | 0.44 | 40 | 6 | 34.0 | 0.45 | ○ | 35.1 | 26.0 | 49.5 |
| 45 | 50 | 34 | 35.05 | 40 | 2.0 | 30 | 20.0 | 57.1 | 0.59 | 40 | 6 | 34.0 | 0.45 | ○ | 35.1 | 26.1 | 49.6 |
| 46 | 50 | 34 | 35.05 | 40 | 2.0 | 30 | 40.0 | 57.1 | 1.18 | 40 | 6 | 34.0 | 0.45 | ○ | 35.1 | 26.6 | 50.6 |
| 47 | 50 | 34 | 35.05 | 40 | 2.0 | 30 | 60.0 | 57.1 | 1.76 | 40 | 6 | 34.0 | 0.4 | ○ | 35.1 | 26.7 | 50.8 |
| 48 | 50 | 34 | 35.05 | 40 | 2.0 | 30 | 80.0 | 57.1 | 2.35 | 40 | 6 | 34.0 | 0.4 | ○ | — | — | — |
| 49 | 50 | 34 | 35.05 | 40 | 40.0 | 1 | 80.0 | *27 | 2.35 | 40 | 6 | 33.5 | 1 | x | 34.5 | 4.1 | *79 |
| 50 | 50 | 34 | 35.05 | 25 | 2.0 | 30 | 8.0 | 57.1 | *0.24 | 40 | 4 | 34.0 | 0.9 | x | — | — | — |
| 51 | 50 | 34 | 35.05 | 25 | 2.0 | 30 | 15.0 | 57.1 | 0.44 | 40 | 4 | 34.0 | 0.4 | ○ | 35.1 | 25.9 | 49.3 |
| 52 | 50 | 34 | 35.05 | 25 | 2.0 | 30 | 20.0 | 57.1 | 0.59 | 40 | 4 | 34.0 | 0.4 | ○ | 35.1 | 26.1 | 49.6 |
| 53 | 50 | 34 | 35.05 | 25 | 2.0 | 30 | 40.0 | 57.1 | 1.18 | 40 | 4 | 34.0 | 0.4 | ○ | 35.1 | 26.0 | 49.5 |
| 54 | 50 | 34 | 35.05 | 25 | 2.0 | 30 | 60.0 | 57.1 | 1.76 | 40 | 4 | 34.0 | 0.4 | ○ | 35.1 | 26.1 | 49.6 |
| 55 | 50 | 34 | 35.05 | 25 | 2.0 | 30 | 80.0 | 57.1 | 2.35 | 40 | 4 | 34.0 | 0.4 | ○ | — | — | — |
| 56 | 50 | 34 | 35.05 | 25 | 25.0 | 1 | 80.0 | *45 | 2.35 | 40 | 4 | 33.5 | 1 | x | 34.5 | 6.8 | *13.1 |

*outside the geometrical range of the invention

Method of Examination

Figure 9:
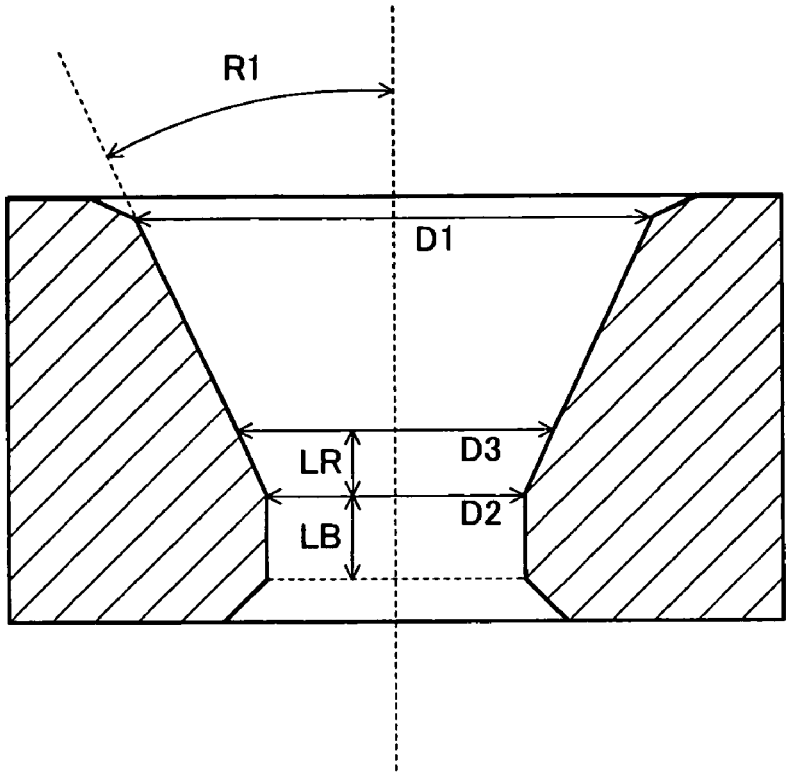
FIG. 9 is a sectional view of the die used in the example.

As shown in FIG. 9, conventional dies each having a fixed die half angle R1 were used in tests Nos. 7, 14, 21, 28, 35, 42, 49, and 56. In FIG. 9, D3=D2/0.97, D2/0.97 holds for D3.

In the tests other than the tests listed above, dies each having two different die half angles R1 and R2 as shown in FIG. 5 were used. In each of the tests, the die half angle R1 was larger than the die half angle R2 (R1>R2).

Table 1 shows the diameters D1 to D3, die half angles R1 and R2, distances LR and bearing portion lengths LB of the dies used in the tests. Based on the sizes of the dies in the tests, F1 and F2 in Equations (5) and (6) were calculated. The calculated F1 and F2 are given in Table 1.

$$F1=LR/((D3-D2)/2) \quad (5)$$

$$F2=LB/D2 \quad (6)$$

With reference to Table 1, the dies used in tests Nos. 2 to 5, Nos. 9 to 12, Nos. 16 to 19, Nos. 23 to 26, Nos. 30 to 34, Nos. 37 to 41, Nos. 44 to 48, and Nos. 51 to 55 all fell within the geometrical range of the invention.

Meanwhile, regarding each of the dies used in tests Nos. 1, 7, 8, 14, 15, 21, 22, 28, 35, 42, 49, and 56, the value F1 did not satisfy Equation (2). More specifically, the value F1 was less than 20 for any of the dies.

Regarding the dies used in tests Nos. 29, 36, 43, and 50, the value F2 did not satisfy Equation (3). More specifically, the value F2 was less than 0.3. The metal pipe as a hollow shell was a carbon steel pipe that had an outside diameter DA and a thickness given in Table 1 and a length of 500 mm.

The metal pipes in the tests were subjected to an extrusion process and manufactured into stepped metal pipes. More specifically, the lower end of the metal pipes were each pushed through a die to protrude a length of 330 mm from the lower end of the die, and then the pipes were pushed back in the direction opposite to the direction in which the metal pipes were extruded.

Figure 10:
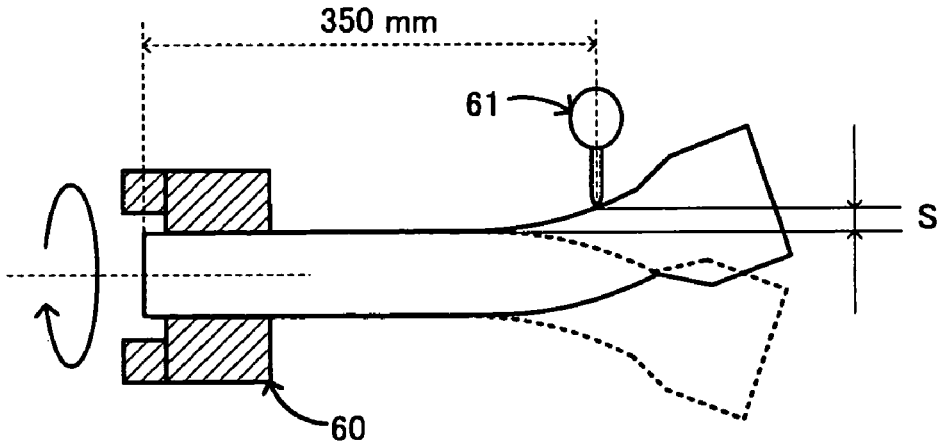
FIG. 10 is a schematic view for illustrating a method of measuring bending in a stepped metal pipe.

After the extrusion process, the reduced outside diameter DB of the hollow cylindrical portion of the stepped metal pipe was measured using a calipers. The bending of the stepped metal pipe was examined. As shown in FIG. 10, the end of the second hollow cylindrical portion of the stepped metal pipe was fixed by a lathe 60. The lathe 60 rotates the stepped metal pipe once in the circumferential direction and the bending amount S of the stepped metal pipe was measured by a dial gauge 61 provided on the surface 350 mm apart from the end fixed to the lathe 60. When the bending amount S was not more than 0.5 mm, the pipe was acceptable (indicated by "○" in Table 1), and when the bending amount S was more than 0.5, the pipe was unacceptable (indicated by "x" in Table 1).

Results of Examination

With reference to Table 1, the bending amounts S of the stepped metal pipes obtained in tests Nos. 2 to 6, Nos. 9 to 13, Nos. 16 to 20, Nos. 23 to 27, Nos. 30 to 34, Nos. 37 to 41, Nos. 44 to 48, and Nos. 51 to 55 were not more than 0.5 mm.

Meanwhile, the bending amounts S of the stepped metal pipes obtained in tests Nos. 1, 7, 8, 14, 15, 21, 22, 28, 35, 42, 49, and 56 were more than 0.5 mm. The outside diameters DB of the stepped metal pipes obtained in these tests were smaller than the diameter D2 (=34.0 mm) of the die. It is considered that since the length LR of each of the dies used in these tests was short, undershooting deformation occurred at the bearing portion, and the bending amounts S exceeded 0.5 mm accordingly.

The outside diameters DB of the stepped metal pipes in tests Nos. 29, 36, 43, and 50 were each 34.0 mm, but the bending amounts S of these pipes were more than 0.5 mm. It is considered that the bearing portion distances LB of the dies were short and therefore the bending was caused even though there was no undershooting deformation.

Note that the thicknesses of the metal pipes had no influence on the bending amounts.

Results of Examination of Geometries of Stepped Pipes

The geometries of the stepped metal pipes manufactured in tests Nos. 7, 14, 21, 28, 35, 42, 49, and 56 by the extrusion process using the conventional dies were compared to the geometries of the stepped metal pipes manufactured in tests Nos. 2 to 5, Nos. 9 to 12, Nos. 16 to 19, Nos. 23 to 26, Nos. 30 to 33, Nos. 37 to 40, Nos. 44 to 47, and Nos. 51 to 54 by the extrusion process using the dies within the geometrical range of the invention. The measurement results of the outside diameters DC and distances LE are given in Table 1. In Table 1, "Exp. (4)" indicates the value of LE/((DC−DB)/2).

Figure 11:
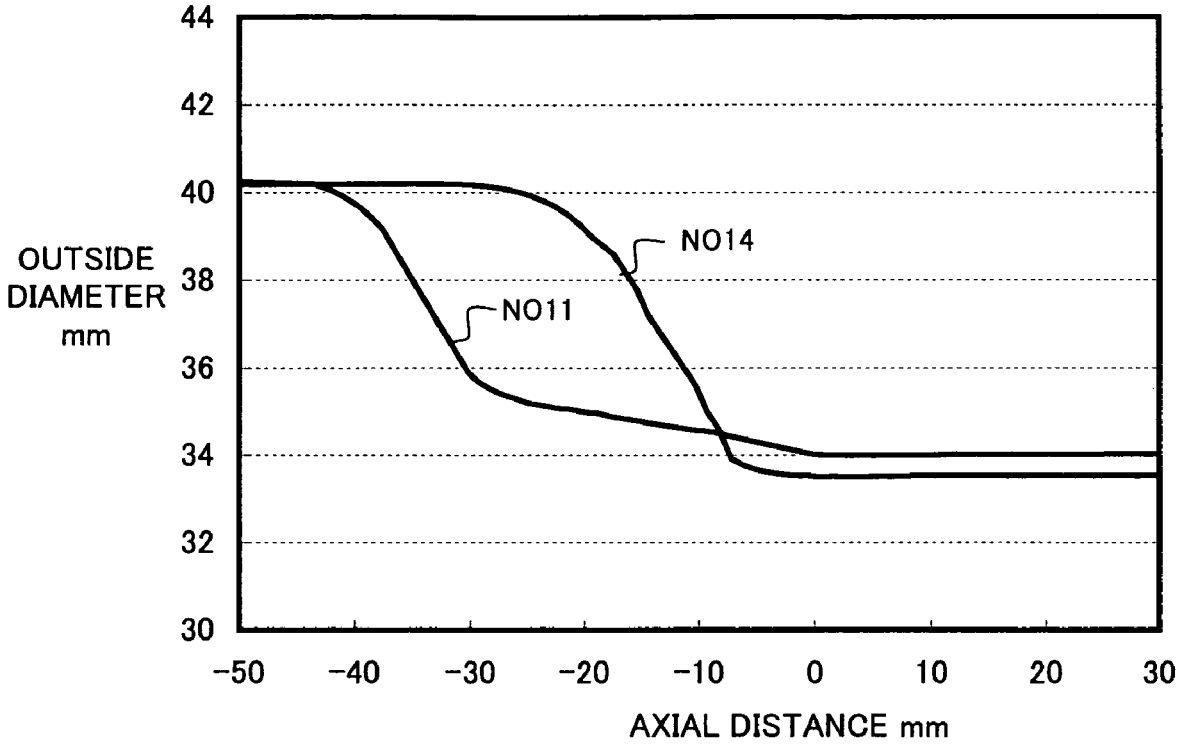
FIG. 11 is a graph showing the results of measuring the outside diameter in various axial positions of a stepped metal pipe.

FIG. 11 shows by way of examples the measurement results of the outside diameter of the stepped metal pipe in test No. 14 using a conventional die and the outside diameter of the stepped metal pipe in test No. 11 using a die within the geometrical range of the invention in various locations in the axial direction. Among the axial locations, those on the side of the second hollow cylindrical portion are positive locations, and those on the side of the first hollow cylindrical portion are negative locations with respect to the boundary between the taper portion and the second hollow cylindrical portion of the stepped metal pipe as a reference point ("0" on the abscissa in FIG. 11). Note that the outside diameters were measured using a calipers. As shown in FIG. 11, the stepped metal pipes in tests No. 14 and No. 11 had considerably different geometries. More specifically, the geometry of the stepped metal pipe in test No. 11 satisfied Equation (4) but that of the stepped metal pipe in test No. 14 did not. Similarly, the geometries of the stepped metal pipes in tests Nos. 2 to 5, Nos. 9 to 12, Nos. 16 to 19, Nos. 23 to 26, Nos. 30 to 33, Nos. 37 to 40, Nos. 44to 47, and Nos. 51 to 54 satisfied Equation (4), but those of the stepped metal pipes in tests Nos. 7, 21, 28, 35, 42, 49, and 56 did not.

The embodiment of the present invention has been shown and described simply by way of illustrating the invention. Therefore, the invention is not limited to the embodiment described above and various changes and modifications may be made therein without departing from the scope of the invention.

The die according to the invention can widely be adopted for an extrusion process to reduce the diameter of a hollow shell, and more specifically it has applicability in an extrusion process to reduce the diameter of a metal pipe or tube as a hollow shell.

What is claimed is:

1. A die having a through hole for use in an extrusion process to reduce a diameter of a metal pipe or tube, the through hole having an inside surface including a bell portion, an approach portion, and a bearing portion from the entrance side of said die formed in a continuous manner, wherein a diameter of the through hole at said bell portion gradually decreases from an entrance part of said bell portion to an exit part of said bell portion, a diameter of said approach portion is D1 on an entrance part of said approach portion and D2 on an exit part of said approach portion, the diameter of said approach portion gradually decreasing from the entrance part of said approach portion to the exit part of said approach portion to satisfy Equation (1):

$$0.7 \leqq D2/D1 < 0.97 \quad (1),$$

a die half angle of a first part of said approach portion having a diameter D3 is not less than a die half angle of a second part of said approach portion nearer to the exit part of said approach portion than the first part, the diameter D3 being D2/0.97, an axial length LR between the first part and the exit part of said approach portion satisfies Equation (2):

$$20 \leqq LR/((D3-D2)/2) \leqq 115 \quad (2),$$

a diameter of said bearing portion is fixed at D2, and a length of said bearing portion is LB, the length LB satisfying Equation (3):

$$0.3 \leqq LB/D2 \leqq 10 \quad (3).$$

2. A method of manufacturing a stepped metal pipe or tube, comprising:

pushing a metal pipe or tube into a die in an axial direction, said die having a through hole for use in an extrusion process to reduce the diameter of a metal pipe or tube, said through hole having an inside surface including a bell portion, an approach portion, and a bearing portion from the entrance side formed in a continuous manner, wherein a diameter of said bell portion gradually decreases from the entrance part of said bell portion to the exit part of said bell portion of the hole, a diameter of said approach portion is D1 on the entrance part of said approach portion and D2 on the exit part of said approach portion, the diameter of said approach portion gradually decreasing from the entrance part of said approach portion to the exit part of said approach portion to satisfy Equation (1):

$$0.7 \leqq D2/D1 < 0.97 \quad (1),$$

a die half angle of a first part of said approach portion having a diameter D3 is not less than a die half angle of a second part of said approach portion nearer to the exit part of said approach portion than the first part, the diameter D3 being D2/0.97, the axial length LR between the first part and the exit part of said approaching portion satisfies Equation (2):

$$20 \leqq LR/((D3-D2)/2) \leqq 115 \quad (2),$$

a diameter of said bearing portion is fixed at D2, and a length of said bearing portion is LB, the length LB satisfying Equation (3):

$$0.3 \leqq LB/D2 \leqq 10 \quad (3),$$

said method comprising, extruding an end of said pushed metal pipe or tube to protrude a prescribed length from the exit side of said die, thereby making the metal pipe or tube into a stepped metal pipe or tube; and stopping extruding and pushing back the stepped metal pipe or tube in the direction opposite to the direction of pushing the metal pipe or tube.

3. The method of manufacturing a stepped metal pipe or tube according to claim 2, wherein said metal pipe or tube is manufactured by a Mannesmann process.

* * * * *